United States Patent [19]

Stauffer

[11] Patent Number: 4,710,308

[45] Date of Patent: Dec. 1, 1987

[54] PROCESS FOR PREPARING OVERBASED SULFURIZED PHENATES

[75] Inventor: Richard D. Stauffer, Wheaton, Ill.

[73] Assignee: Amoco Corporation, Chicago, Ill.

[21] Appl. No.: 601,476

[22] Filed: Apr. 18, 1984

Related U.S. Application Data

[63] Continuation of Ser. No. 366,428, Apr. 8, 1982, abandoned.

[51] Int. Cl.[4] ..... C10M 129/00

[52] U.S. Cl. ..... 252/42.7; 252/18

[58] Field of Search ..... 252/42.7, 18

[56] References Cited

U.S. PATENT DOCUMENTS

| | | | |
|---|---|---|---|
| 2,680,096 | 6/1954 | Walker et al. | 252/42.7 |
| 2,808,377 | 10/1957 | Davidson et al. | 252/42.7 |
| 3,410,798 | 11/1968 | Cohen | 252/42.7 X |
| 3,437,595 | 4/1969 | Coupland | 252/42.7 |
| 3,464,970 | 9/1969 | Sakai et al. | 260/137 |
| 3,493,516 | 2/1970 | Allphin, Jr. et al. | 252/42.7 X |
| 3,801,507 | 4/1974 | Hendrickson et al. | 252/42.7 |
| 3,933,659 | 1/1976 | Lyle et al. | 252/42.7 X |
| 4,123,371 | 10/1978 | Hori et al. | 252/42.7 |
| 4,302,342 | 11/1981 | Demoures et al. | 252/42.7 X |

FOREIGN PATENT DOCUMENTS

| | | | |
|---|---|---|---|
| 697534 | 11/1964 | Canada | 252/42.7 |

*Primary Examiner*—William R. Dixon, Jr.
*Assistant Examiner*—Cynthia A. Prezlock
*Attorney, Agent, or Firm*—Scott H. Brown; Fred E. Hook

[57] ABSTRACT

Overbased sulfurized phenates formed by the process comprising contacting at reaction conditions a composition comprising a phenolic compound, sulfur and an alkaline earth metal base selected from the group consisting of calcium, barium, magnesium, and strontium, in an amount insufficient to fully react with the phenolic compound, and contacting the above intermediate composition with an additional amount of alkaline earth metal base and carbon dioxide, wherein the molar ratio of carbon dioxide absorbed to overbasing alkaline earth metal is from about 0.70 to about 0.95.

5 Claims, No Drawings

PROCESS FOR PREPARING OVERBASED SULFURIZED PHENATES

This is a continuation of copending application Ser. No. 366,428 filed Apr. 8, 1982, now abandoned.

BACKGROUND OF THE INVENTION

1. Field of the Invention

This invention relates to compounds useful as antioxidants and detergents in lubricating oils and methods for their manufacture and, more specifically, to overbased sulfurized phenates.

2. Setting of the Invention

Lubricating oils tend to deteriorate under normal operating conditions encountered in present-day diesel and automotive engines. Sludge, lacquer and residence materials can form and adhere to engine parts (especially piston rings, grooves and skirts) possibly having a deleterious effect on engine efficiency, operation and useful life. Commonly, additives are added to lubricating oils to reduce the formation of such harmful materials and/or to keep them suspended so that the engine parts are kept clean and operating properly. Additives which reduce the tendency of lubricating oils to form oxidation products are called antioxidants, while additives which tend to suspend oxidation products and sludges are called detergents or dispersants. It is not uncommon for certain additives to exhibit both antioxidant and detergency properties. We have found that sulfurized metal phenates are quite useful as antioxidants as well as dispersants. These phenates are generally formed with an alkaline earth metal base, such as calcium, barium, magnesium, and strontium.

The manufacture of overbased sulfurized phenates has been accomplished by several different processes. One such process involves the reaction of a phenol, sulfur and an alkaline earth metal base with carbon dioxide. The present invention relates to this type of process and is exemplified by U.S. Pat. Nos. 3,036,971 and 3,194,761, which are expressly incorporated herein by reference.

It has been found that in the manufacture of lubricating oil compositions which contain overbased sulfurized metal phenates that a haze or gel can form when the phenate is mixed with bright stock oils. We believe that this haze or gel is due to overcarbonating the phenate. In the manufacture of the phenate product, carbon dioxide is added to a reaction vessel and the amount of carbon dioxide leaving the vessel is closely monitored. When the amount of carbon dioxide leaving the vessel suddenly increases this indicates that the carbon dioxide absorption has ceased and carbonation is complete. In practice it has been found that even if the injection of carbon dioxide is stopped immediately at the end of carbon dioxide absorption, the products still tend to be overcarbonated and this can cause bright stock solubility problems. We have discovered that by undercarbonating the overbased sulfurized phenate that the bright stock solubility problems can be eliminated. One method of undercarbonating is to limit the amount of carbon dioxide absorbed. Various prior art patents disclose limiting the amount of carbon dioxide absorbed; however, none of the patents disclose limiting the amount of carbon dioxide absorbed to prevent bright stock solubility problems. Further, we have found that if the alkaline earth metal is added in a single charge or stage and then carbonated, the viscosity of the reaction product increases to a level where stirring of the reaction mixture becomes difficult and the reaction may not be complete.

U.S. Pat. No. 2,916,454 to Bradley et al. discloses limiting the amount of carbon dioxide absorbed to a molar ratio of 0.2–0.6 carbon dioxide:phenolic compound. Bradley does not disclose the use of an inorganic earth metal base, such as calcium, but requires the use of complex metal alcoholates, such as barium, magnesium or sodium. U.S. Pat. No. 3,036,971 to Otto discloses the reaction of an alkyl phenol, calcium hydroxide, sulfur, and a mutual solvent. Otto discloses limiting the amount of carbon dioxide absorbed to a molar ratio of 0.2–0.6 carbon dioxide:calcium. Nowhere is it disclosed in Otto to conduct the carbonation in stages to prevent the reaction product from becoming too viscous. Both of these patents fail to disclose the concept of limiting the amount of carbon dioxide absorbed to control bright stock solubility.

U.S. Pat. Nos. 3,178,368 to Hanneman and 3,336,224 to Allphine disclose the reaction of calcium sulfonate, a phenolic compound, mutual solvent, and a high molecular weight alcohol. The amount of carbon dioxide absorbed is limited to 0.1 to 3.0 moles of carbon dioxide per mole of phenolic compound. Nowhere is it disclosed in these patents to undercarbonate to control bright stock solubility or to add an alkaline earth metal base in stages to prevent an increase in the viscosity of the reaction product. Further, both Hanneman and Allphin require the use of high molecular weight alcohols in the reaction. The use of these alcohols is economically unattractive because the alcohols are expensive and must be distilled out of the final product before blending.

U.S. Pat. No. 3,194,761 to Fox et al. discloses the reaction of a diluent oil,, alkylphenol, hydrated lime, sulfur and a mutual solvent. Carbon dioxide is bubbled through the mixture until no more than 0.5 moles of carbon dioxide is absorbed per mole of calcium. Thereafter, an additional amount of hydrated lime is added. U.S. Pat. No. 3,350,310 to Herd et al. discloses the reaction of hydrated lime, methanol and carbon dioxide at 10°–30° C. Thereafter phenol sulfide and a diluent are added. The amount of carbon dioxide absorbed is limited to 0.4–0.8 moles of carbon dioxide per mole of calcium. Both of these patents fail to disclose the concept of undercarbonating to control bright stock solubility. The process of Foy et al. and Herd do not disclose the addition of an alkaline earth metal base in stages to control viscosity. Further, the process of Herd requires the use of methanol and a phenol sulfide.

U.S. Pat. No. 3,923,670 to Crawford discloses the reaction of an alkyl phenol, sulfur, an alkali metal hydroxide and ethylene glycol to which is added additional alkali metal hydroxide and carbon dioxide. In Crawford there is no limit on the amount of carbon dioxide absorbed, and thus there is no suggestion of undercarbonating to improve bright stock solubility or to carbonate in stages to control viscosity.

There exists a need for a process to manufacture overbased sulfurized phenates which can have multiple carbonation stages to control viscosity and which produces a product that has no bright stock solubility problems.

DESCRIPTION OF THE PERFERRED EMBODIMENTS

The present invention provides a novel overbased sulfurized phenate produced by the process comprising contacting at reaction conditions sulfur, a phenolic compound and an alkaline earth metal base to produce a phenate intermediate. Thereafter, the phenate intermediate is contacted at reaction conditions with an additional amount of the alkaline earth metal base and carbon dioxide, wherein the amount of carbon dioxide absorbed is in the ratio of about 0.70–0.95 moles per mole overbasing alkaline earth metal. For the purposes of this invention, overbasing alkaline earth metal is defined as the total moles of alkaline earth metal minus one-half of the moles of phenolic compound. For example: if 1.04 moles of phenolic compound and 0.69 moles of $Ca(OH)_2$ are added in the production of the phenate intermediate and 0.89 moles of $Ca(OH)_2$ are added to the phenate intermediate, then the overbasing alkaline earth metal is $(0.69+0.89)-(1.04/2)$ or 1.06 moles.

Accordingly, patents that suggest that the amount of carbons dioxide added be dependent upon the total moles of phenolic compound or the total moles of alkaline earth metal base do not appreciate the novel concept of controlling bright stock solubility problems by controlling the ratio of moles of carbon dioxide absorbed to overbasing alkaline earth metal base present. In other words the present invention is not dependant upon controlling the simple ratio of carbon dioxide to phenolic compound or alkaline earth metal base but to a specific combination of phenolic compound, alkaline earth metal base and carbon dioxide.

Briefly, the novel process of this invention comprises the reaction of sulfur, a phenolic compound and an alkaline earth metal base which is, in an amount insufficient to fully react with the phenolic compound, a mutual solvent and a diluent to produce a phenate intermediate. The alkaline earth metal base added in the sulfurization step to produce the phenate intermediate is from about 20% to 75% of the total amount added and, preferably from about 40% to 60%. In certain circumstances it may be desirable to calculate the amount of alkaline earth metal base added in the sulfurization step based upon the phenolic compound. In this case the amount of alkaline earth metal base added is from 0.40 to about 0.75 moles per mole of phenolic compound. The phenate intermediate is contacted with additional alkaline earth metal base and carbon dioxide bubbled into the mixture. The phenate intermediate can be contacted with the additional amount of the alkaline earth metal base in stages to control the viscosity of the reaction product. For example, the phenate intermediate can be contacted with two additional charges of the alkaline earth metal base and carbon dioxide with the last charge being about 10 percent smaller in volume than the previous additional charge. This procedure is especially useful in controlling the viscosity of the reaction mixture in large reaction vessels or under already high viscosity conditions. Regardless of the methods employed, the amount of carbon dioxide absorbed should be in the ratio of about 0.70 to about 0.95 moles per mole of overbasing alkaline earth metal.

Carbon dioxide can be added in the carbonation step along with or after the addition of the additional overbasing alkaline earth metal base. If the additional alkaline earth metal base is added in stages the carbon dioxide can be added (a) continuously while the alkaline earth metal base is added, (b) introduced after each addition is completed, or (c) added only after the final addition of alkaline earth metal base.

The total base number (TBN) of the final overbased sulfurized phenate product of this invention can vary over a wide range; however, the TBN should be between 200 and 300, and preferably close to 250 TBN.

The sulfur utilized is preferred to be elemental sulfur. Sulfur is used in an amount from about 0.3 to about 2.5 moles of sulfur per mole of total alkaline earth metal base incorporated. It is preferred to use from about 0.7 to about 1.25 moles of sulfur per mole of alkaline earth metal base incorporated.

The phenolic compounds utilized are hydrocarbyl substituted phenols. The benzene ring can contain various other substitutants such as chlorine, bromine, nitro and others. The most commonly used substituted phenols contain one or more hydrocarbyl groups having about 1 to about 100 carbon atoms. Preferably, the hydrocarbyl groups contain about 8 to about 20 carbon atoms. The hydrocarbyl groups can be alkyl, alkenyl, aralkyl or alkaryl. For reasons of cost and availability monoalkylphenols are preferred. Monoalkyl substitution in the para position is preferred. Suitable hydrocarbon substitution can comprise low molecular weight groups such as methyl, ethyl, propyl, isopropyl, butyl, isobutyl and the various isomers of pentyl, heptyl, octyl, nonyl, decyl, undecyl, dodecyl and the like, including low molecular weight polymers and copolymers. Commercially available substituted phenols contain from 8 to 20 carbon atoms substituents from polypropylene or polybutene. The hydrocarbyl substituted phenol can have other substituents, such as for example: chlorine, bromine, nitro, and the like.

The alkaline earth metal base comprises a base of divalent metals such as calcium, barium, magnesium, and strontium. The preferred metal bases are the oxides and hydroxides of the various metals, such as calcium oxide, calcium hydroxide, barium oxide, barium hydroxide, magnesium oxide, and the like. Calcium hydroxide, commonly called hydrated lime, is most often used in the manufacture of these phenates. It is preferred to use hydrated lime of good quality, relatively free of carbonates, which has not deteriorated during storage. In certain cases, the carbonate, methoxides or other forms of base may be used for certain metals such as magnesium.

Both the sulfurization and the carbination reactions can be conducted in the presence of a promoter or organic liquid which is sometimes referred to as a "mutual solvent." The mutual solvent can comprise any stable organic liquid which has appreciable solubility for both the alkaline earth metal base and the phenolic compound and intermediate phenate. While a wide variety of mutual solvents can be used, suitable solvents are glycols and glycol monoethers, such as ethylene glycol, 1,4-butene diol, and derivatives of ethylene glycol, such as the monomethyl ether, monoethyl ether, etc. Vicinal glycols are preferred and ethylene glycol is the most preferred since it serves to activate the neutralization reaction in the process and to that extent typifies a catalyst, although the exact characteristics describing its function are unknown.

Both the sulfurization and the carbonation reactions can be conducted in a diluent, preferably a lubricating oil which remains unseparated from the final product. The reaction diluent serves to reduce the viscosity of the intermediate phenate to make it readily transferable by pumping operations and the like. The amount of diluent used can vary over a wide range, but is used in a concentration to achieve a suitable intermediate or product viscosity for reaction and transfer while not unduly diluting the final product when the diluent will not be separated from the final product. Mineral lubricating oils are preferred as diluents since the ultimate use of the sulfurized metal phenates is often in oil additives. However, any inert water-insoluble organic medium which will not react or interfere with the reaction of the process is suitable. Although hydrocarbon oils and particularly petroleum oils are generally utilized in this process, other oils can also be used, such as synthetic, hydrocarbon, polymer oils prepared by condensation or other methods. Light lubricating oils are particularly preferred and may be of a synthetic, animal, vegetable or mineral origin. Mineral lubricating oils are preferred by reason of their availability, general excellence and low cost. The lubricating oils preferred will be fluid oils, ranging in viscosity from about 40 Saybolt Universal Seconds at 100° F. (38° C.) to about 200 Saybolt Universal Seconds at 210° F. (99° C.).

The molar ratios of the materials utilized in the present process can vary over a wide range depending upon the desired level of sulfur to be present in the final product and the desired TBN. The molar ratios for phenolic compound:alkaline earth metal base are about 1:0.4–2. The final product can have molar ratios of phenolic compound:alkaline earth metal base of about 1:0.5–0.7 for a low base material and about 1:1.5–1.8 for high based materials. The molar ratios for phenolic compound:sulfur can be 1:8–1.2 for low base materials and about 1:1.5–1.8 for high based materials. The molar ratios for phenolic compound:carbon dioxide can be about 1:0.5–1.3. However, it is critical that the molar ratio of carbon dioxide to overbasing alkaline earth metals be about 0.70 to about 0.95.

The sulfurization and the carbonation reactions of this invention can be conducted at temperatures from about 200° F. to about 400° F. (94° C.–205° C.). Preferably, the reactions are conducted at temperatures from about 300° F. to about 360° F. (148.8°–182.2° C.). Higher temperatures within this range are preferred for several reasons. The higher temperatures aid in reducing the harmful effect of water in the reaction, which will be discussed in detail later, and to prevent phenate-sulfonate compatibility (PSC) problems. At lower reaction temperatures PSC problems can manifest themselves by the formation of an insoluble, hazy substance in the product. By conducting the reactions at above 300° F. the PSC problems can be eliminated or at least substantially reduced.

The overbased sulfurized phenates produced by the present process can be mixed with any suitable lubricating oil basis or compositions. The concentration of the overbased sulfurized metal phenates in the final lubricating oil composition depends upon the type of base oil used and the particular properties desired. The concentration can range from about 0.75 to about 15 weight percent with the major portion of the lubricating oil composition being the oil. Many different oils can be used such as naphthenic, paraffin and mixed base oils, coal oils and synthetic oils. Further, other additives can be included in the final product to provide multi-functional properties, such as stabilizers, extream pressure agents, tackiness agents, antiodor agents, pour point depressants, viscosity index improvers, antiwear agents, antioxidants, anticorrodants, metal deactivators, etc.

In the preferred embodiment of the present invention, the method of undercarbonating is accomplished by limiting the amount of carbon dioxide to about 0.7–0.95 moles of carbon dioxide per mole of overbasing alkaline earth metal. None of the prior art processes I know of contemplate (a) reacting sulfur, a phenolic compound and an amount of alkaline earth metal base insufficient to react with the phenolic compound to form a phenate intermediate, and (b) contacting the phenate intermediate with an additional amount of the alkaline earth metal base and carbon dioxide, wherein the amount of carbon dioxide absorbed is limited to 0.70–0.95 moles per mole of overbasing alkaline earth metal. The amount of alkaline earth metal base should not be reduced when undercarbonating because it is primarily the base which keeps the oxidation products suspended. It should be noted that I have found that undercarbonating below the limits disclosed can cause other problems. For example, if 0.5 moles of carbon dioxide per mole of overbasing alkaline earth metal is used in the present process, the carbonization would be incomplete and the final product would be unstable and not exhibit the required antioxidant and dispersant characteristics.

As another embodiment of the present invention to prevent overcarbonation, I have found that a solvent can be used in place of the diluent oil to make the observable carbon dioxide absorption, the point at which no more carbon dioxide can be absorbed, to coincide exactly with the point at which the carbon dioxide introduction should be stopped to successfully undercarbonate the phenate product. I have discovered that the use of an aromatic solvent, such as xylenes or $C_9$ aromatics in lieu of all or a significant portion of the diluent oil will coalesce the observable and the optimum end points of the carbon dioxide absorption. Termination of carbon dioxide introduction at the observed point while using those solvents has resulted in overbased sulfurized phenates having excellent bright stock solubility. The preparation of the overbased sulfurized phenates using these solvents is essentially the same as has been described above; however, all or a portion of the diluent oil can be left out of the process. It is desirable to retain up to about 46 percent of the normal amount of diluent oil to control the viscosity during the sulfurization step. In the process using solvents the reaction mixture is cooled to under about 275° F. when adding the xylene or $C_9$ aromatics, mutual solvent and calcium hydroxide. Carbonation is initiated when the reaction mixture has been heated to about 300° to 310° F., which is the reflux temperature of the $C_9$ aromatics or about 285° F. for the xylenes. A mixture of water and mutual solvent, such as ethylene glycol, can be removed during the carbonation step to prevent water build up in the reaction vessel. When the carbonation reaction is complete, the introduced solvents and other volatile materials are stripped from the reaction mixture as the the required amount of diluent oil is added. The use of these solvents can be particularly helpful in undercarbonating the phenate product when utilizing very high viscosity starting materials or when the viscosity of the reaction mixture needs to be especially low.

I have also found that the formation of water during the process of this invention can have a harmful effect on the bright stock solubility of the final phenate product. Water is continuously produced in the process and can be removed by conducting the process under a vacuum or by refluxing any introduced solvents, such as xylene. When 5-weight oil is used as the diluent, the concentration of water in the reaction vessel appears to reach a steady state and no additional water can be removed from the reaction vessel about two-thirds of the way through the carbonation step. If carbonation is allowed to continue beyond this point, poor bright stock solubility can result from overcarbonation. In contrast, finished products utilizing xylene as a solvent with continuous water removal range from only slightly hazy to bright and clear in the bright stock solubility tests. I know that aromatic solvents, such as xylenes and $C_9$ aromatics, are excellent solvents for preparing overbased sulfurized phenates when using bright stock base oils. Paraffnic solvents, such as 5-W oil and doecane do not have as good solvent characteristics as the aromatic solvents. We also know that the two azeotropes, $H_2O$+ xylenes and $H_2O$+ dodecane, have about the same composition and boiling points while 5-W oil+$H_2O$ do not form an azeotrope and water removal is poor. Therefore, since xylenes and dodecane form similar types of azeotropes, the nature of the solvent used (polar vs. nonpolar) probably has an effect on micelle structure and hence on the ability to remove water from the process.

Various methods can be undertaken to minimize the production of water, during the reaction, such as a purge of the reaction mixture with nitrogen gas during the carbonation step, the use of insulated jackets around the upper portions of the reactor vessel, and carbonating at higher temperatures. Also, substituting calcium oxide for the calcium hydroxide should assist in dehydrating the reaction mixture. Although the stoichiometry of the calcium oxide process should not require the removal of water, the system can be easily overcarbonated at 300° F. if the carbon dioxide absorption is allowed to continue to the observable break point when not using xylene or $C_9$ aromatics. Conducting the carbonation under dehydrating conditions using a 360° F. carbonation temperature and insulating the reaction vesses has significantly decreased the amount of water generated in the reaction mixture.

I have found that the concentration of water should be reduced to a minimum approximately two-thirds of the way through the carbonation. At this point, the reaction mixture becomes extremely hydroscopic and the undesired side reaction leading to overcarbonation takes place. It should be noted that a dehydrating step can generate a viscous mass which cannot be easily carbonated at lower mixing efficiencies, so the stepwise carbonation of the present process is most useful in controlling the viscosity of the reaction mixture.

The following examples are provided only to aid in illustrating the invention and are not to limit or restrict the invention in any way.

EXAMPLE I—PROCESS CONDUCTED USING A REDUCED AMOUNT OF CARBON DIOXIDE

Into a two liter flask was added a mixture of 272 g (1.04 m) of dodecylphenol, 260 g of 5-weight oil as diluent, 47 g (1.47 m) of elemental sulfur, 51 g (0.69 m) of $Ca(OH)_2$ and 80 g (1.29 m) of ethylene glycol. The mixture was heated at 300° F. for two hours. Thereafter, 66 g (0.89 m) of $Ca(OH)_2$ was added and the reaction mixture was treated with carbon dioxide gas injected at 1.2 liters/min. at 300° F. until 18.3 liters (0.82 m) of carbon dioxide was absorbed (in about 23 min.). The resulting product was stripped by injection of nitrogen gas ($N_2$) at 450° F. and then filtered through diatomaceous earth. The physical properties of the final product are shown in Table I.

EXAMPLE II—PROCESS CONDUCTED USING AN INCREASED AMOUNT OF CARBON DIOXIDE

The same procedure was followed as in Example I except that carbon dioxide injection was continued until 1.08 m were absorbed. The physical properties of the final product are shown in Table I.

EXAMPLE III—PROCESS CONDUCTED USING AN INCREASED PHENATE CONCENTRATION

Into a two liter flask was added 403 g (1.54 m) of dodecylphenol, 260 g of 5-weight oil as diluent, 68 g (2.14 m) of elemental sulfur, 65 g (0.88 m) of $Ca(OH)_2$ and 80 g (129 m) of ethylene glycol. The mixture was heated to 300° F. for two hours. Thereafter, 72 g (0.97 m) of $Ca(OH)_2$ was added and the reaction mixture was treated with carbon dioxide gas injected at 1.2 liters/min. at 300° F. until 23.9 liters (1.00 m) of carbon dioxide was absorbed (in about 30 min.). The resulting product was stripped by injection of nitrogen gas ($N_2$) at 450° F. and then filtered through diatomaceous earth. The physical properties of the final product are shown in Table I.

EXAMPLE IV—PROCESS CONDUCTED USING AN INCREASED TEMPERATURE OF REACTION

The same procedure was followed as in Example I except that the sulfurization was conducted at 360° F. and 40 g (0.65 m) of ethylene glycol was added prior to the second addition of $Ca(OH)_2$. The physical properties of the final product are shown in Table I.

| Example | Concentration Factor (a) | Overbasing Metal (b)/Phenol | $CaCO_3$/Phenol (c) | $CO_2$/Overbasing Metal (d) | TBN | Viscosity (e) | B.S.S. (f) | % Sediment |
|---|---|---|---|---|---|---|---|---|
| I. | 1.05 | 1.02 | 0.79 | 0.77 | 253 | 928 | B/C | 0.8 |
| II. | 1.05 | 1.02 | 1.04 | 1.02 | 258 | 621 | Hazy | 0.6 |
| III. | 1.55 | 0.70 | 0.70 | 0.93 | 245 | 1,251 | B/C | 1.0 |
| IV. | 1.05 | 1.02 | 0.80 | 0.77 | 236 | 786 | B/C | 0.3 |

(a) Concentration Factor = (gm) phenol/(gm) diluent oil
(b) Overbasing Metal equals that in excess of [phenol (m)/2]
(c) Assuming all $CO_2$ is converted to $CaCO_3$
(d) $CO_2$ (m)/[total alkaline earth metal (m)-(phenol (m)/2)]
(e) 210° F., SUS
(f) Bright Stock Solubility (BSS); B/C = bright/clear

EXAMPLE V—USE OF 5-W OIL AND $C_9$ AROMATICS

Into a two liter flask was added a mixture of 272 g (1.04 m) of dodecylphenol, 120 g 5-weight oil (about 46 percent of that normally used), 80 g (1.30 m) of ethylene glycol, 47 g (1.47 m) of elemental sulfur and 51 g (0.69 m) of $Ca(OH)_2$ and was heated to 300° F. for 2 hours. The reaction mixture was cooled to about 250–275° F. by adding 160 g of $C_9$ aromatics, 40 g (0.65 m) of ethylene glycol and 75 g (1.0 m) of $Ca(OH)_2$. The reaction mixture was heated to reflux (300°–310° F.) and thereafter carbonated with carbon dioxide injection at 0.79 liters/min. until absorption ceased at 23 liters absorbed. One hundred and forty grams (140 g) of 5-weight oil was added as the product was stripped by a purge of nitrogen gas ($N_2$) at 450° F. The product was then filtered through diatomaceous earth. The physical properties of the final product are shown in Table II.

EXAMPLE VI—USE OF 5-W OIL AND XYLENES

Into a two liter flask was added a mixture of 272 g (1.04 m) of dodecylphenol, 120 g of 5-weight oil, 80 g (80 g (1.28 m) of ethylene glycol, 40 g (1.25 m) of elemental sulfur and 51 g (0.69 m) of $Ca(OH)_2$ and was heated to 300° F. for 2.5 hours. The reaction mixture was cooled to about 250°–275° F. and 100 g of xylenes and 60 g (0.97 m) of ethylene glycol were added. The mixture was heated to reflux (275°–285° F.) and 75 g (1.0 m) of $Ca(OH)_2$ was added. Carbon dioxide injection was initated at 1.22 liters/min. and continued until absorption ceased a 26.3 liters absorbed. One hundred and forty grams (140 g) of 5-weight oil was added as the product was stripped by a purge of nitrogen gas ($N_2$) at 450° F. The product was then filtered through diatomaceous earth. The physical properties of the final product are shown in Table II.

EXAMPLE VII—USE OF CaO AND SULFURIZATION AT 360° F.

Into a 5 liter flask was added 179 g of CaO, 952 g of dodecylphenol 910 g of 5-weight oil as diluent, 224 g of ethylene glycol, and 165 g of elemental sulfur. This reaction mixture was heated with a spherical heating mantle to 360° F. and maintained at 360° F. for 2 hours. Water was removed from the flask in a Dean Stark trap. A total of 127 g of distillate was removed which contained 73 g of water (as determined by the Karl Fisher method). The flask with the phenate intermediate was maintained at 360° F. and carbon dioxide was bubbled into the mixture at 1.68 l/min. unil 7 liters were absorbed. One hundred grams (100 g) of calcium oxide and 63 ml of ethylene glycol were added. The carbon dioxide injection was reinitiated at 1.68 l/min. until 33 liters were absorbed (31 min.). During carbonation, 81 g of distillate containing 14 g of water was collected. The product was then stripped by injection of nitrogen gas ($N_2$) at 450° F. and then filtered through diatomaceous earth. The physical properties of the final product are shown in Table II.

TABLE II

| Examples: | V | VI | VII |
|---|---|---|---|
| Temperatures (°F.) Sulfurization | 300° | 300° | 360° |
| Carbonation | 300° | 280° | 360° |
| Concentration Factor (a) | 1.05 | 1.05 | 1.05 |
| Overbasing Metal/Phenol (b) | 1.14 | 1.14 | 1.14 |
| $CaCO_3$/Phenol (c) | 1.00 | 1.13 | .91 |
| $CO_2$/Overbasing Metal (d) | .89 | .90 | .82 |
| Carbonation Rate (l/min.) | 0.79 | 1.22 | 1.68 |
| $CO_2$ absorbed (e) | 23.0 | 26.3 | 40.0 |
| TBN | 257 | 257 | 256 |
| Viscosity (f) | 845 | 1016 | 736 |
| B.S.S. (g) | B/C | B/C | B/C |
| % Sediment | 7.2 | 0.4 | trace |

(a) Concentration Factor = (gm) phenol/(gm) diluent oil
(b) Overbasing metal equals that in excess of (phenol (m)/2)
(c) Assuming all $CO_2$ is converted to $CaCO_3$
(d) $CO_2$ (m)/[total Group II metal (m)-(phenol (m)/2)]
(e) Liters of $CO_2$ absorbed at break point
(f) 210° F., SUS
(g) Bright Stock Solubility (BSS); B/C = bright/clear As can be seen from the above examples various methods can be used singularly or in combination to improve the bright stock solubility of overbased sulfurized metal phenates. The most important of these methods being undercarbonating the phenate product which yields a product which has excellent antioxidant and dispersant qualities.

Whereas the present invention has been described in particular relation to the examples and embodiments disclosed herein, it should be understood that other and further modifications of the present inventions, apart from those shown or suggested herein, may be made within the scope and spirit of the invention.

I claim:

1. A process for the manufacture of overbased sulfurized phenates comprising:

(a) contacting at a temperature of between about 200° F. to about 400° F., a composition comprising a hydrocarbyl substituted phenol, sulfur and an alkaline earth metal oxide or hydroxide wherein the molar ratio of hydrocarbyl substituted phenol to sulfur is 1:1–1.8, and wherein the amount of alkaline earth metal oxide or hydroxide added is from 0.40 to about 0.75 moles per mole of hydrocarbyl substituted phenol; and (b) contacting the composition of (a) with an additional amount of alkaline earth metal oxide or hydroxide and carbon dioxide, wherein the molar ratio of carbon dioxide to overbasing alkaline earth metal oxide or hydroxide is from about 0.70 to about 0.95 and wherein the molar ratio of hydrocarbyl substituted phenol to alkaline earth metal oxide or hydroxide is about 1:0.5–1.8.

2. The process of claim 1 wherein the additional alkaline earth metal oxide or hydroxide and carbon dioxide are added in stages.

3. The process of claim 1 wherein the alkaline earth metal oxide or hydroxide is calcium hydroxide or calcium oxide.

4. The process of claim 1 wherein any water produced in steps (a) and (b) is removed.

5. A lubricating oil composition comprising a major portion of a lubricating oil and an overbased, sulfurized phenate made in accordance with claim 1 with a concentration of from 0.75 to about 15 wt %.

* * * * *

UNITED STATES PATENT OFFICE

CERTIFICATE OF CORRECTION

PATENT NO. : 4,710,308

DATED : December 1, 1987

INVENTOR(S) : Richard D. Stauffer

It is certified that error appears in the above-identified patent and that said Letters Patent are hereby corrected as shown below:

Column 7, line 39, "vesses" should read --vessels--.

Column 9, line 34, "a" should read --at--.

Signed and Sealed this

Twenty-third Day of August, 1988

*Attest:*

DONALD J. QUIGG

*Attesting Officer*

*Commissioner of Patents and Trademarks*